US006618701B2

(12) United States Patent
Piket et al.

(10) Patent No.: US 6,618,701 B2
(45) Date of Patent: Sep. 9, 2003

(54) METHOD AND SYSTEM FOR NOISE SUPPRESSION USING EXTERNAL VOICE ACTIVITY DETECTION

(75) Inventors: James Brian Piket, Gilbert, AZ (US); Ernest Pei-Ching Chen, Gilbert, AZ (US); Christopher Wayne Springfield, Gilbert, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/293,901

(22) Filed: Apr. 19, 1999

(65) Prior Publication Data

US 2002/0152066 A1 Oct. 17, 2002

(51) Int. Cl.[7] ..... G10L 11/02
(52) U.S. Cl. ..... 704/233; 704/226; 704/215
(58) Field of Search ..... 704/226, 225, 704/233, 201, 210, 215, 227

(56) References Cited

U.S. PATENT DOCUMENTS

| | | | | | |
|---|---|---|---|---|---|
| 4,052,568 | A | * | 10/1977 | Jankowski | 704/233 |
| 4,672,669 | A | * | 6/1987 | DesBlache et al. | 704/226 |
| 5,276,765 | A | * | 1/1994 | Freeman et al. | 704/233 |
| 5,278,944 | A | * | 1/1994 | Sasaki et al. | 704/212 |
| 5,553,134 | A | * | 9/1996 | Allen et al. | 379/387 |
| 5,659,622 | A | | 8/1997 | Ashley | 381/94 |
| 5,781,883 | A | * | 7/1998 | Wynn | 704/226 |
| RE35,867 | E | * | 8/1998 | Sugiyama | 364/724.19 |
| 5,839,101 | A | | 11/1998 | Vahatalo et al. | 704/226 |
| 5,875,423 | A | | 2/1999 | Matsuoka | 704/220 |
| 5,881,091 | A | | 3/1999 | Bartz | 375/200 |
| 5,926,060 | A | * | 7/1999 | Olgaard et al. | |
| 5,963,901 | A | * | 10/1999 | Vahatalo et al. | 704/233 |
| 6,023,674 | A | * | 2/2000 | Mekuria | 704/233 |
| 6,061,647 | A | * | 5/2000 | Barrett | 704/208 |
| 6,097,820 | A | * | 8/2000 | Turner | 381/94.3 |
| 6,108,610 | A | * | 8/2000 | Winn | 704/226 |

FOREIGN PATENT DOCUMENTS

| | | | |
|---|---|---|---|
| EP | 0335521 | 10/1989 | G10L/3/00 |
| EP | 0665530 | 8/1995 | G10L/3/02 |
| EP | 0784311 | 7/1997 | G10L/3/00 |
| WO | 9801847 | 1/1998 | G10L/3/00 |

* cited by examiner

*Primary Examiner*—Daniel Abebe
(74) *Attorney, Agent, or Firm*—Ingrassia Fisher & Lorenz

(57) ABSTRACT

A communications transmitter which operates as a mobile telephone incorporates a noise suppressor (100, FIG. 1) which reduces the background noise in the transmitted voice signal. An external voice activity detector (150), which operates in conjunction with a noise suppressor (100) estimates the signal power of the incoming voice signal and compares this to an estimated noise floor. As a result of this comparison, a voice activity factor is applied to an updated noise floor estimate to create a voice activity threshold estimate. The voice activity threshold estimate is then used to decide whether or not to the force noise suppressor (100) to perform an update of a noise content estimate of the incoming voice signal.

16 Claims, 3 Drawing Sheets

METHOD AND SYSTEM FOR NOISE SUPPRESSION USING EXTERNAL VOICE ACTIVITY DETECTION

FIELD OF THE INVENTION

The invention relates to communication systems and, more particularly, to noise suppression of transmitted voice signals.

BACKGROUND OF THE INVENTION

In a communications system, a transmitting station may employ a noise suppression mechanism in order to reduce the noise content of a transmitted voice signal. This can be particularly useful when the transmitting station is a mobile handset or hands-free telephone operating in the presence of background noise. In these environments, a sudden increase in background noise can cause a far-end listener to hear an undesirable level of noise. This problem is particularly apparent when the transmitter station is operating as a mobile station and the transmitter station includes noise suppression technology. While current noise suppression techniques are effective in reducing background noise in a static or slowly changing noise environment, noise suppression performance can be significantly degraded when the transmitting station is operated in the presence of a rapidly changing noise environment.

In mobile environments, large changes in background noise can be brought about when the user of the mobile transmitter activates a fan, lowers a window while the mobile station is in motion, or is otherwise subjected to significant and sudden changes in the background noise within the mobile station. The background noise within the mobile unit can also be affected by numerous other changes within the mobile station.

In typical mobile transmitters which use voice activity detection internal to a noise suppression algorithm, an increase in background noise can be interpreted by the noise suppression algorithm as a voice signal from the user of the mobile transmitter. This condition is brought about due to the inter-dependency between the voice activity detection and the noise floor estimate computed by the noise suppression algorithm. One noise suppression technique, such as a stationary spectral check, has been used with some success in order to mitigate be effects of sudden increases in background noise. However, in practice, this solution has been shown to be inadequate in many cases due to the time required for the noise suppression algorithm to reduce the background noise to an acceptable level. In some cases, this time period can be 10–20 seconds in duration. In other cases, the system can experience a locked fault condition in which noise floor updates cease to occur. This results in the transmitter being placed in a condition where the listener is subjected to an unacceptable amount of noise for an extended period of time.

Therefore, it is highly desirable for the noise suppression method and system to adapt to sudden increases in background noise through the use of a voice activity detector with reduced inter-dependency between voice activity detection and noise floor estimates. Such a system would provide a capability for lower noise transmissions while a mobile station is operating in the presence of widely varying background noise.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

DESCRIPTION OF THE PREFERRED EMBODIMENTS

A method and system for improved noise suppression using an external voice activity detector provides a capability to conduct voice communications in the presence of widely varying background noise. The method and system correct a shortcoming in many noise suppression techniques by providing faster noise updates which minimizes the noise heard by the listening station. Additionally, the locked fault condition where noise updates cease to occur is avoided. These result in a hands-free communications system which does not subject a far-end listener to a noise burst when an increase in background noise occurs.

Figure 1:
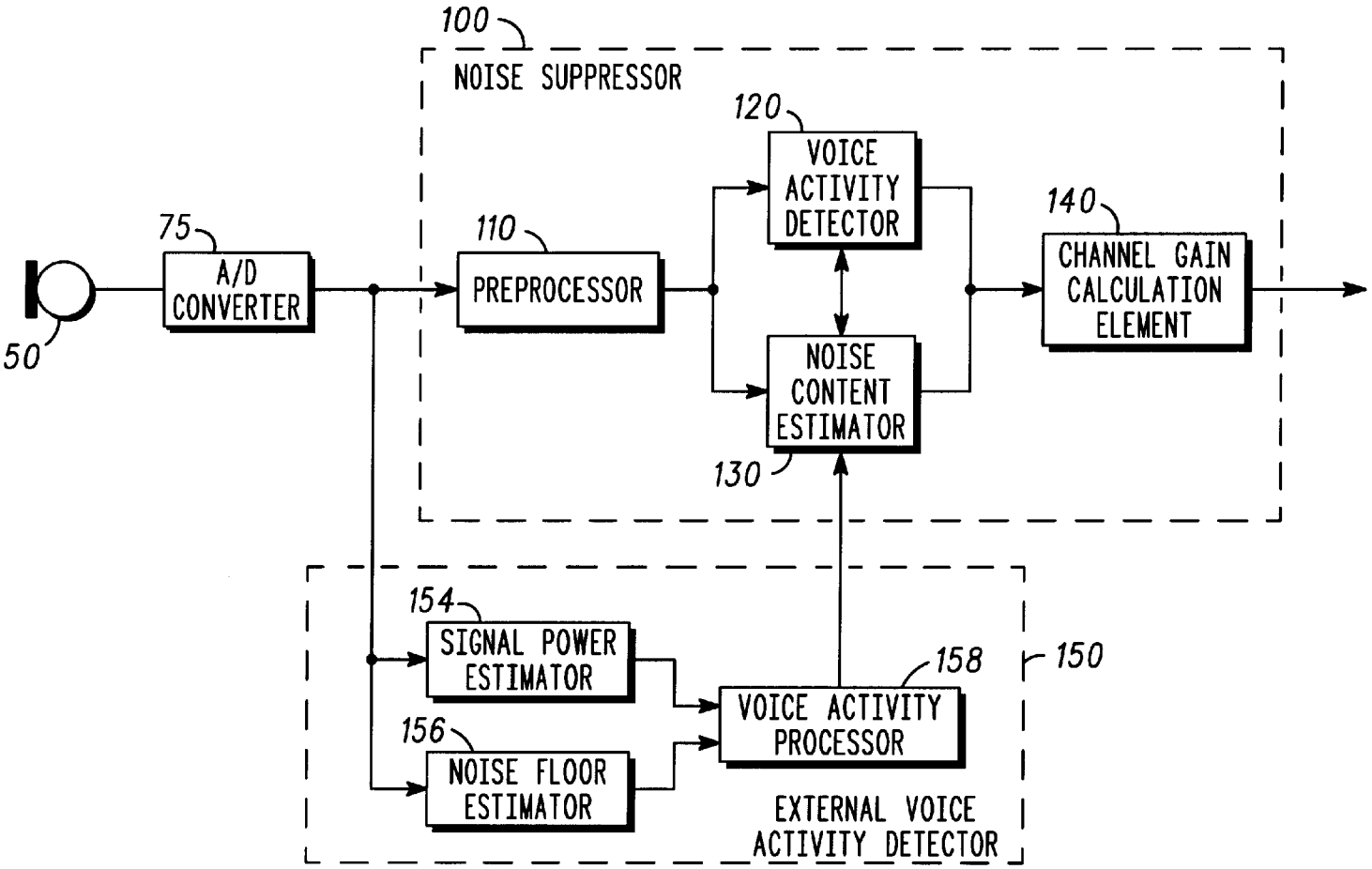
FIG. 1 is a block diagram of a transmitter which employs voice activity detection using and external voice activity detector in accordance with a preferred embodiment of the invention.

FIG. 1 is a block diagram of a transmitter which employs voice activity detection using and external voice activity detector in accordance with a preferred embodiment of the invention. In FIG. 1, microphone 50 receives acoustic energy and converts this energy to an electrical signal. Microphone 50 can be any type of the microphone or other transducer which converts mechanical or acoustic vibrations into electrical signals. Microphone 50 is coupled to analog to digital converter 75 which converts the incoming analog electrical signal to a digital representation. Analog to digital converter 75 can be any general purpose type of converter which preferably possesses sufficient sampling rate and dynamic range in order to produce accurate digital representations of the incoming analog voice signals from microphone 50.

The output of analog to digital converter 75 is input to noise suppressor 100 which includes preprocessor 110, voice activity detector 120, noise content estimator 130, and channel gain calculation element 140. An output of analog to digital converter 75 is additionally coupled to external voice activity detector 150. In a preferred embodiment, noise suppressor 100 is illustrative of a variety of noise suppressors suitable for use in conjunction with the present invention. Additionally, the functions of noise suppressor 100 may be performed entirely as one or more software processing elements, or may be performed in hardware where individual functions are performed by discrete and dedicated processing elements.

In FIG. 1, preprocessor 110 receives the digital representations of voice signals from analog to digital converter 75. In a preferred embodiment, preprocessor 110 performs any required spectral conditioning functions in which certain spectral bands, preferably those which contain primarily voice, are emphasized, while other spectral bands, such as those which contain primarily noise, are de-emphasized. Additionally, preprocessor 110 may also perform conversion from a time domain signal to a frequency domain signal in order to allow the remaining portions of noise suppressor 100 to perform additional manipulations on the digital representations of the voice signals.

The output of preprocessor 110 is coupled to voice activity detector 120, and noise content estimator 130. In a preferred embodiment, voice activity detector 120 performs voice detection based on the noise floor and channel energy statistics of the digital representations of the voice signals from preprocessor 110. Noise content estimator 130 measures the background noise present in the digital representations of the voice signals from preprocessor 110.

The output of voice activity detector 120 and noise content estimator 130 are then coupled to channel gain calculation element 140. In a preferred embodiment, channel gain calculation element 140 segments the digital representations of the voice signals into a group of frequency bins. By way of the segmentation of voice signals into frequency bins, channel and gain calculations can be performed on specific frequency bands which primarily contain voice information. Additionally, those frequency bands which primarily contain noise information can be attenuated.

As shown in FIG. 1, noise content estimator 130 and voice activity detector 120 are coupled in order to perform a voice activity decision which is based on the noise content of the digital representations of the voice signal from preprocessor 110. Thus, voice activity detector 120 determines voice activity by way of receiving an input from noise content estimator 130.

In FIG. 1, external voice activity detector 150 performs a separate voice activity determination in order to assist noise content estimator 130 in determining the noise content of the digital representation of the voice signals from preprocessor 110. In a preferred embodiment, external voice activity detector determines voice activity without an input from noise content estimator 130. Importantly, the external noise floor estimate is not tied Through removing the dependency of noise floor determination on voice activity detection decisions, a more reliable voice activity detection mechanism can be provided for use in environments where background noise changes rapidly.

External voice activity detector 150, accepts inputs of digital representations of voice signals from analog to digital converter 75. These inputs are coupled to signal power estimator 154, and noise floor estimator 156. Signal power estimator 154 performs computations in order to determine the signal power present in the input signal. Noise floor estimator 156 performs calculations on the input signal in order to ascertain the noise floor of the signal input.

Outputs from signal power estimator 154 and noise floor estimator 156 are coupled to voice activity processor 158 which compares the levels of signal power and noise floor in order to determine whether an update of noise content estimator 130, should be performed. The method used by signal power estimator 154, noise of floor estimator 156, voice activity processor 158 is discussed further in reference to FIG. 3. The output of voice activity 158 is coupled to noise suppressor 100. In a preferred embodiment, this output consists of an indicator which can force noise content estimator 130 to perform a noise estimate of the digital representations of the voice signal from preprocessor 110.

Figure 2:
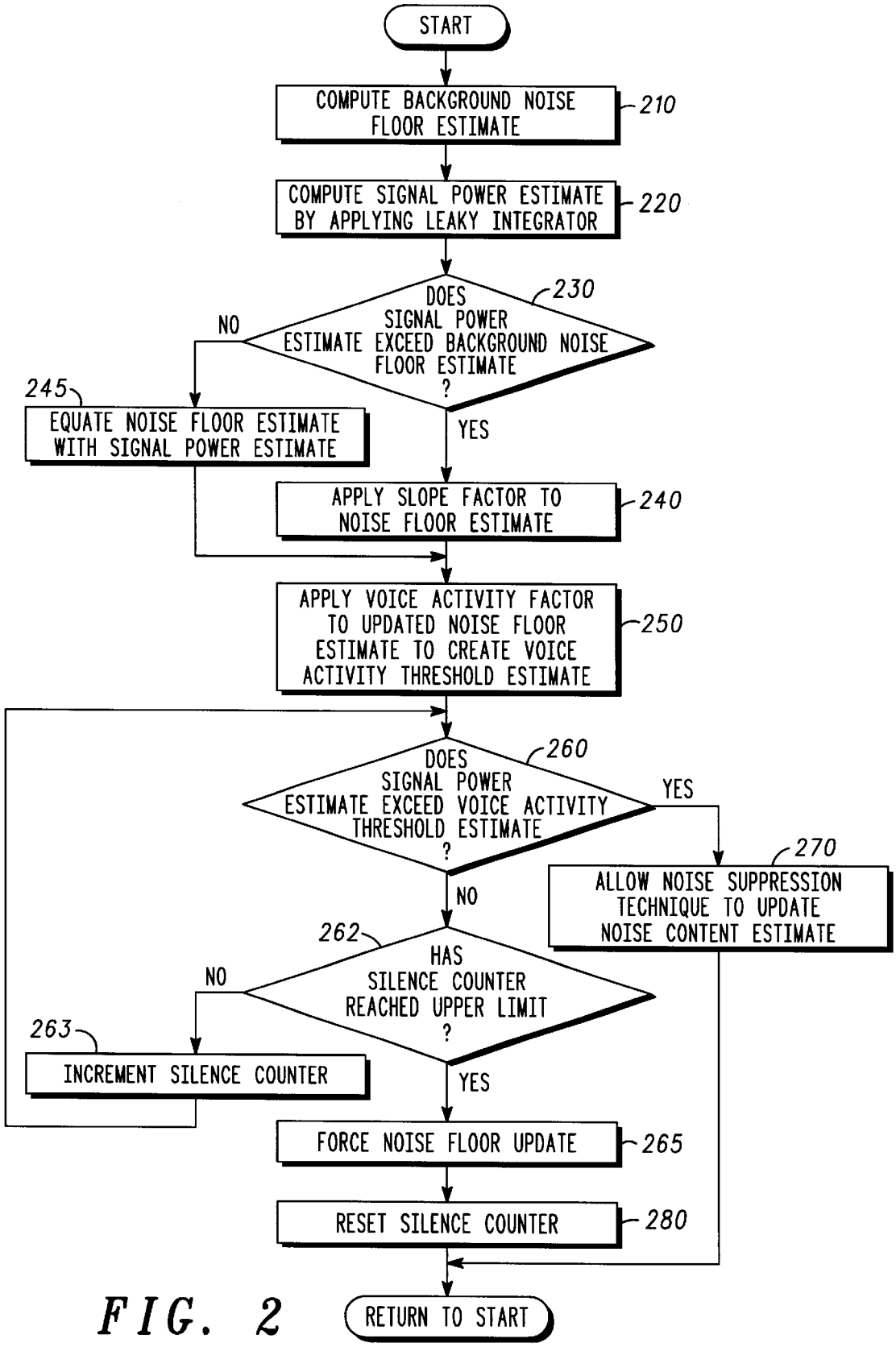
FIG. 2 is a flowchart of a method for noise suppression using an external voice activity detector in accordance with a preferred embodiment of the invention.

FIG. 2 is a flow chart of a method performed by an external voice activity detector in accordance with a preferred embodiment of the invention. External voice activity detector 150 of FIG. 1 is suitable for performing the method. The method of FIG. 2 begins with the voice activity detector computing a background noise floor estimate. By way of example, and not by way of limitation, this estimate is based upon a slow rise/fast-fall technique designed to track changes in the noise floor of a particular signal. Preferably, the technique does not require an assumption as to whether the incoming digital representation of a voice signal is either voice or noise. As each sample, denoted by y(n) is processed, an estimate of the current signal power is desirably updated in step 220 by way of an integration function such as the leaky integrator shown in the equation below.

$$P_y(n)=(1-\theta)y^2(n)+\theta P_y(n-1),\text{ where }\theta=0.9875$$

In step 230, the current signal power estimate is compared to the noise floor estimate. If the signal power estimate exceeds the noise floor estimate, which can indicate a decrease in the noise level of the incoming voice signal, the updated noise floor is set equal to the signal power estimate in step 245. This produces the desired "fast fall" in the noise floor. If the signal power estimate exceeds the noise floor estimates, symbolizing a increase in noise level, a slope factor is applied to the noise floor estimate (in step 240) to cause a slow rise rambling of the current noise floor estimates at a rate of decibels per second. The algorithm for steps 230, 240 and 245 can be expressed as:

If $(P_y(n)<NF_y(n-1))$ then $NF_y(n)=P_y(n)$
else
$NF_y(n)=\beta(NF_y(n-1))$ where $\beta\approx 2$ to 8 dB per second
Endif.

In step 250, a voice activity factor, a, is applied to the updated noise floor estimates to create a voice antivity threshold estimate, $(\alpha(NF_y(n))$. The method then continues in step 260 where the signal power estimate is compared with the voice activity threshold estimates from step 250. Step 260 is the primary decision as to whether or not to force the noise suppression technique to update the noise content estimate of the digital representations of the voice signal, although typical implementation would preferably also employ well-known techniques such as hangover periods and hysteresis.

If the signal power estimate exceeds the voice activity threshold estimate, then the external voice activity detector allows the noise suppression technique to update the noise content estimate, as in step 270. In the event that the signal power estimate does not exceed the voice activity threshold estimate, step 262 is executed in which a determination is made as to whether an upper limit of a silence counter has been reached. If the upper limit of the silence counter has not been reached, step 263 is executed in which the counter is incremented, and the method returns to step 260. A complete description of the purpose and preferred numerical values of the silence counter is described with reference to FIG. 3.

If the decision of step 262 indicates that the upper limit of the silence counter has been reached, step 265 is executed in which the external voice activity sensor forces the noise suppression technique to update the noise content estimate. Step 280 is then executed where the silence counter is rest. After executing steps 265 through 280, the method returns to step 210, where the next frame of digital representations of voice signals is evaluated. The algorithm for steps 250, through 280 can be expressed as:

If $P_y(n)>\alpha(NFy(n))$ then do not force update
else
force update, increment silence counter, and check threshold
endif.

Figure 3:
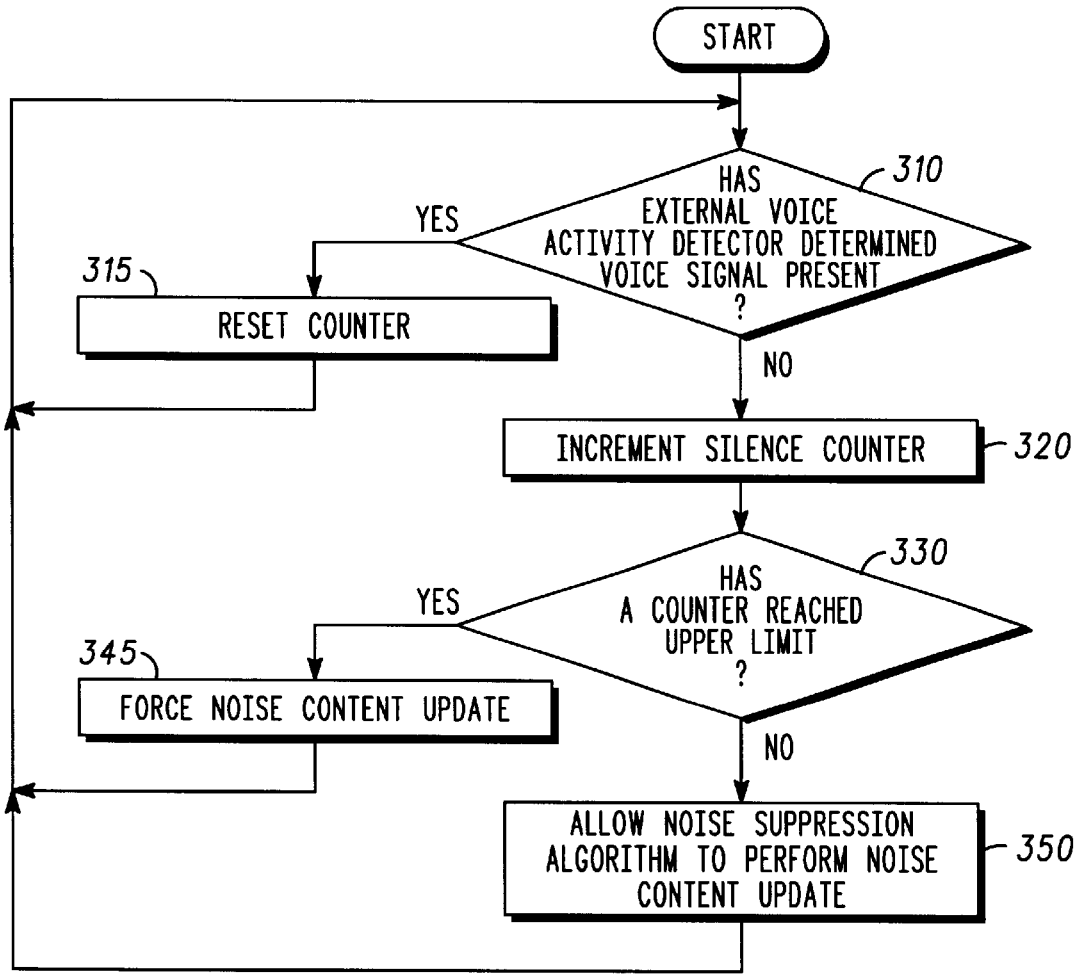
FIG. 3 is a flowchart of a method used by an external voice activity detector to control the updating noise content estimate performed by a noise suppression algorithm in accordance with a preferred embodiment of the invention.

FIG. 3 is a flow chart of a method used by an external voice activity detector to control the updating of a noise content estimate performed by a noise suppression algorithm in accordance with a preferred embodiment of the invention. The method begins in step 310 where an external voice activity detector, such as external voice activity detector 150 of FIG. 1, determines if voice activity is present. Step 310 represents the outcome of voice activity detection, such as that described in reference to FIG. 2, in which a noise content estimate is forced if the appropriate conditions are present. If step 310 determines that voice activity is not present, step 320 is executed where a counter is incremented. In step 330, a check is performed to determine if the current value of the counter has reached an upper limit. In a preferred embodiment, the upper limit for the counter is set to equal 20.

If the upper limit of the counter has been reached, the external voice activity detector forces an update of the noise content of the incoming digital representations of a voice signal and the method returns to step 310. If, however, step 330 determines that the upper limit has not been reached, the method executes step 350 where the external voice activity detector allows the noise suppression algorithm to determine if an update in the noise content of an incoming digital representation of a voice signal is required. The method then returns to step 310. If the external voice activity detector determines that a voice signal is present, as in step 310, a counter is reset in step 315 and the method returns to step 310.

Steps 320 through 340 allow a noise update only after a relatively long "hangover" period has occurred. The use of a hangover period restricts the noise suppression algorithm to performing a noise content estimate only after a hands-free subscriber has stopped talking. Thus, noise content estimates are not performed during the voice the pauses which occur during normal speech. Additionally, the use of a counter to limit the time between forced updates of the noise content of the voice signal limits the length of the hangover period. By limiting the length of the hangover period, the locked fault condition in which the noise suppression algorithm ceases to update the noise content estimate can be avoided. Thus preventing the far-end listener from be subjected to high levels of noise.

A method and system for improved noise suppression using an external voice activity detector provides a capability to conduct voice communications in the presence of widely varying background noise. The method and system correct a shortcoming present in many noise suppression techniques by forcing the noise suppression technique to perform noise content estimates on incoming digital representations of voice signals under certain conditions. This, in turn, minimizes the noise heard by the listening station. Additionally, the locked fault condition where noise updates cease to occur, is avoided. The method and system result in a hands-free communications system which does not subject a far-end listener to a noise burst when an increase in background noise occurs.

Accordingly, it is intended by the appended claims to cover all modifications of the invention that fall within the true spirit and scope of the invention.

What is claimed is:

1. In the transmitter which performs a noise suppression technique on an incoming voice signal, the noise suppression technique using an internal voice activity detector, a method for controlling an update of a noise content estimate of said incoming voice signal in the internal voice activity detector, comprising the steps of:

estimating a background noise floor of the incoming voice signal using a second voice activity detector external to the noise suppression technique;

estimating a signal power of the incoming voice signal using the second voice activity detector;

comparing the background noise floor estimate to the signal power estimate;

updating the background noise floor estimate based upon the comparing step, wherein the step of updating the background noise floor estimate comprise raising the background noise floor estimate at a slope factor when the signal power estimate exceeds the background noise floor estimate;

applying a voice activity factor to the updated background noise floor estimate to create a voice activity threshold estimate;

comparing the signal power estimate to the voice activity threshold estimate; and forcing an update of the noise content estimate in the internal voice activity detector when the signal power estimate does not exceed the voice activity threshold estimate for a determined period of time.

2. The method of claim 1, wherein the slope factor is approximately in the range of 2 to 8 decibels per second.

3. The method of claim 1 wherein the step of updating comprises equalizing the background noise floor estimate to the signal power estimate when the signal power estimate does not exceed the background noise floor estimate.

4. The method of claim 1 wherein the voice activity factor is approximately in the range of 8 decibels.

5. The method of claim 1 further comprising the step of allowing the internal voice activity detector to update the noise content estimate in the internal voice activity detector if the signal power estimate is greater than the voice activity threshold estimate.

6. The method of claim 1 wherein the step of estimating a signal power comprises the step of integrating a previous signal power estimate.

7. The method of claim 6 wherein said integrating step further comprises the step of applying a leaky integrator factor.

8. The method of claim 7 wherein the leaky integrator factor is approximately in the range of 99/100.

9. A transmitter for conveying a voice signal to a remote receiver comprising:

a first voice activity detector;

a noise content estimator coupled to the first voice activity detector;

a second voice activity detector, coupled to the noise content estimator, the second voice activity detector comprising:

a signal power estimator for computing a signal power estimate of said voice signal;

a noise floor estimator for estimating a noise floor of said voice signal independent of a voice activity state; and a voice activity processor coupled to said signal power estimator and to said noise floor estimator, the voice activity processor:

updating a background noise floor estimate based upon a comparison of the signal power estimate and the noise floor estimate, wherein the voice activity processor updates the background noise floor estimate by raising the background noise floor estimate at a slope factor when the signal power estimate exceeds the background noise floor estimate;

applying a voice activity factor to the updated background noise floor estimate to create a voice activity threshold estimate;

comparing the signal power estimate to the voice activity threshold estimate; and forcing an update of the noise content estimator when the signal power estimate does not exceed the voice activity threshold estimate for a determined period of time.

10. The transmitter of claim 9 wherein the slope factor is approximately in the range of 2 to 8 decibels per second.

11. The transmitter of claim 9 wherein voice activity processor updates the background noise floor estimate by equalizing the background noise floor estimate to the signal power estimate when the signal power estimate does not exceed the background noise floor estimate.

12. The transmitter of claim 9 wherein the voice activity factor is approximately in the range of 8 decibels.

13. The transmitter of claim 9 wherein the noise content estimator determines updates to the noise content estimate in the first voice activity detector if the signal power estimate is greater than the voice activity threshold estimate.

14. The transmitter of claim 13 wherein the signal power estimator estimates the signal power comprises the step by integrating a previous signal power estimate.

15. The transmitter of claim 14 wherein the signal power integrates the previous power estimate by applying a leaky integrator factor.

16. The transmitter of claim 15 wherein the leaky integrator factor is approximately in the range of 99/100.

* * * * *